US005976024A

United States Patent [19]

Marshall, Jr.

[11] Patent Number: 5,976,024

[45] Date of Patent: Nov. 2, 1999

[54] APPARATUS FOR ENHANCEMENT OF GOLFER'S SWING

[76] Inventor: Roger Lawrence Marshall, Jr., 2911 B Ave. E, Holmes Beach, Fla. 34217

[21] Appl. No.: 09/114,884

[22] Filed: Jul. 14, 1998

[51] Int. Cl.[6] ..... A63B 69/36

[52] U.S. Cl. ..... 473/227; 473/409

[58] Field of Search ..... 473/227, 409

[56] References Cited

U.S. PATENT DOCUMENTS 5,203,568 4/1993 Vasquez ..... 473/227 X 5,846,143 12/1998 Brock et al ..... 473/227 X

*Primary Examiner*—George J. Marlo

*Attorney, Agent, or Firm*—Jacox, Meckstroth & Jenkins

[57] ABSTRACT

The golf swing enhancer apparatus for use with a golf club comprises a collar which is engagingly connected to the golf club at a position immediately adjacent the grip of the club; and two L-shaped arms each connected to the collar at a first end and extending outwardly from the collar and upwardly towards the top of the club and each having a curved member at a second end. The curved members engaging with the forearms of the golfer at certain positions in a full swing of the golf club when the full swing is correctly executed by the golfer.

27 Claims, 5 Drawing Sheets

APPARATUS FOR ENHANCEMENT OF GOLFER'S SWING

BACKGROUND OF THE INVENTION

The present invention relates to an apparatus for enhancing a golfer's swing. Specifically, it describes a training device which may be attached to a golf club to assist a golfer with achieving the correct club face rotation throughout the back swing and through-swing, achieving proper hinging and release of the golf club during the back swing and through-swing, properly positioning both of his arms when he is at the top of his back swing of the golf club, at the initiation of his down swing of the golf club, the through swing and at the end of the follow-through swing. By achieving proper rotation and hinge of the club and the correct arm positions, the golf club stays on its proper swing plane thereby enabling the golfer to achieve a well-executed shot. The apparatus also overcomes the deficiencies of prior golf training devices because it is not required be rigidly attached to the golfer's wrists, hands or arms, as prior golf training devices have required and, moreover, is useful for training golfers in the full swing of a club, rather than being limited to training a golfer to putt, or chip which is the case with many prior golf training devices.

For example, U.S. Pat. No. 2,273,416 to Norwood describes a golf instruction device which includes a harness that is attached to a golfer's right wrist (for a golfer with a right-handed swing) and a rigid guide which contacts the top of the club above the hands. This device does not address positioning of both hands and arms, nor is it directed to correction of the swing. Rather, it is designed to train a golfer in correcting his putting and the shorter approach shots.

U.S. Pat. No. 3,951,416 to Koch describes a golf training device which includes a clamp at the top of the golf club and a clamp that attaches to the wrist of the golfer's trailing arm. The training device is designed to improve the golfer's short swings and putting. It is not applicable to training for full swings. Moreover, the device restricts the golfer to use of a "choked-up" grip because one of the clamps is positioned at the top of the club.

U.S. Pat. No. 5,203,568 to Vasquez discloses a device which is designed to train golfers in putting. It does not address a full swing. Similarly, U.S. Pat. No. 5,320,354 to Vasquez discloses a device to train golfers in pitching and putting and does not address a full swing.

U.S. Pat. No. 5,667,447 to Perham et al. relates to a movement sensing device which is attached to a golfer's leading arm and extends between the forearm to midway up the bicep, encasing the elbow. The device includes electronic sensors which alert the golfer when the leading arm is not properly positioned. The device is directed solely to the proper positioning of the leading arm.

U.S. Pat. No. 5,248,146 to Viets et al. discloses a device which attaches to the top of the golf club and includes two rigid clamps for each arm. Once again, this patent is concerned only with arm positioning for putting and does not address full swing positioning.

SUMMARY OF THE INVENTION

It is therefore an object of the present invention to provide an apparatus which can be used to train a golfer in achieving the correct club face rotation throughout the back swing and through-swing.

It is another object of the present invention to provide an apparatus which can be used to train a golfer in achieving proper hinging and release of the golf club during the back swing and through-swing.

It is yet another object of the present invention to provide an apparatus which can be used to train a golfer on proper arm positioning for shots requiring a full swing of a golf club.

It is a further object of the present invention to provide an apparatus which can be used to train a golfer on proper arm positioning for a back swing, a down swing and a follow-through swing of a golf club.

It is an additional object of the present invention to provide an apparatus which is relatively easy to assemble and use and which is not required to be rigidly attached to a golfer's wrists, hands or arms.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the golf swing enhancer apparatus of this invention for use with a golf club, the golf club including a shaft, a grip and a club face, the club face for contacting a golf ball on the down swing of a full swing of the golf club by a golfer, the apparatus comprising: a collar engagingly connected to the golf club at a position immediately adjacent the grip; and two L-shaped arms, each of the two L-shaped arms being connected to the collar at a first end and extending outwardly from the collar and upwardly towards the top of the club, each of the two L-shaped arms having a curved member at a second end, each of the curved members engaging with a separate one of the forearms of the user of the golf club during various points in the full swing of the golf club when the golfer properly executes the full swing.

The accompanying drawings, which are incorporated in and constitute a part of this specification, illustrate one embodiment of this invention and, together with the description, serve to explain the principles of the invention.

DETAILED DESCRIPTION OF THE PREFERRED EMBODIMENT

Figure 1:
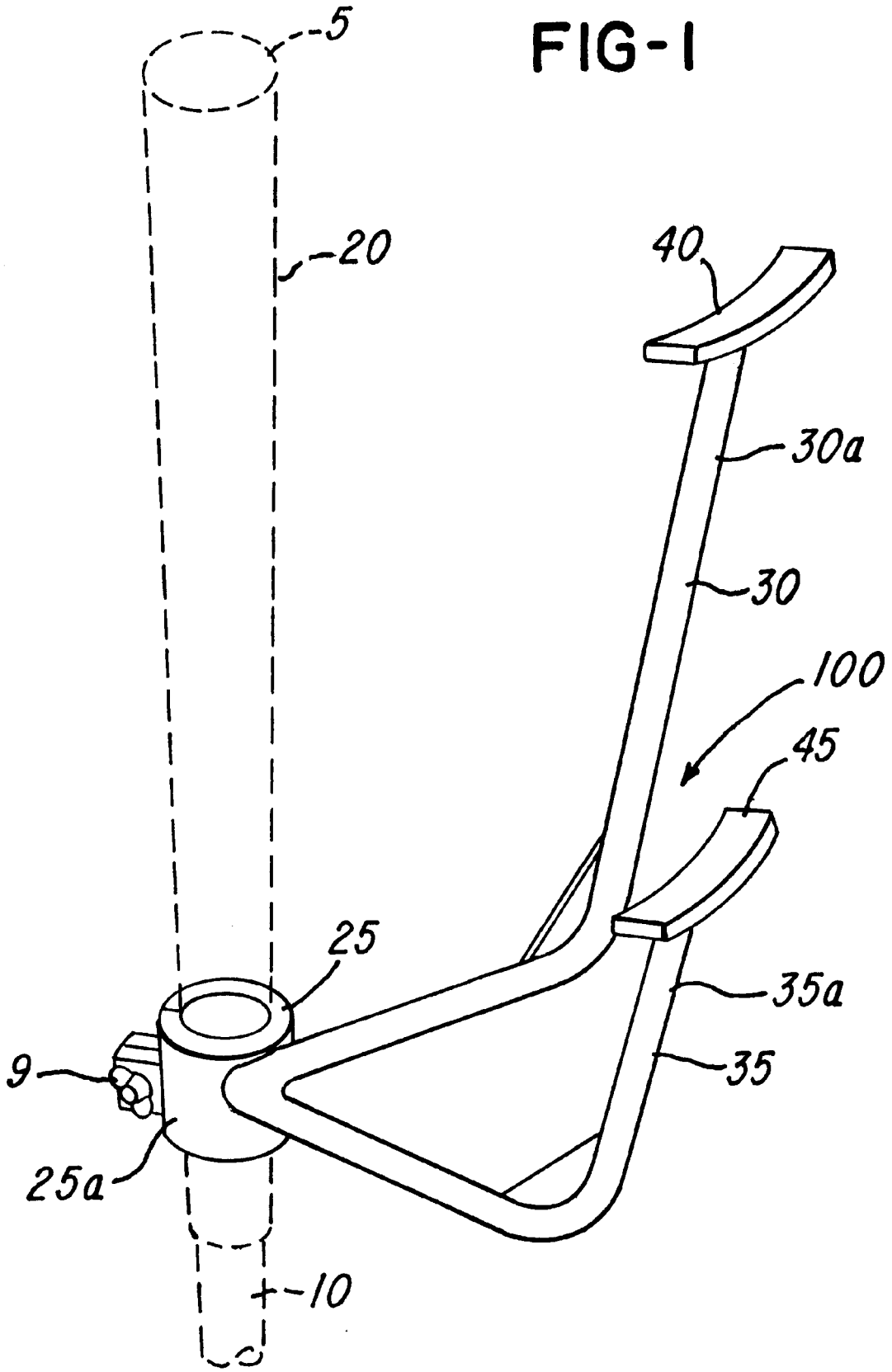
FIG. 1 is a side perspective view of the apparatus of the present invention.

Reference will now be made in detail to the present preferred embodiment of the invention, an example of which is illustrated in the accompanying drawings in which like reference characters refer to corresponding elements.

In order for a golfer to develop a well-executed full golf swing which can be used for any shot off a tee or from a fairway or any other shot requiring that the golfer's arm be fully extended, as compared to a chip shot, a quick uplift or a putt, the golfer must practice development of all four parts of the full swing. The four parts of the full swing are the back swing, the down swing, the through-swing and ball contact and the follow-through. In order to have a well-executed full swing of the golf club, the golfer must have the proper stance positioning, the proper grip of the club, proper club and arm positioning and correct motion of the body and rotation of the club through the four parts of the swing.

Figure 3:
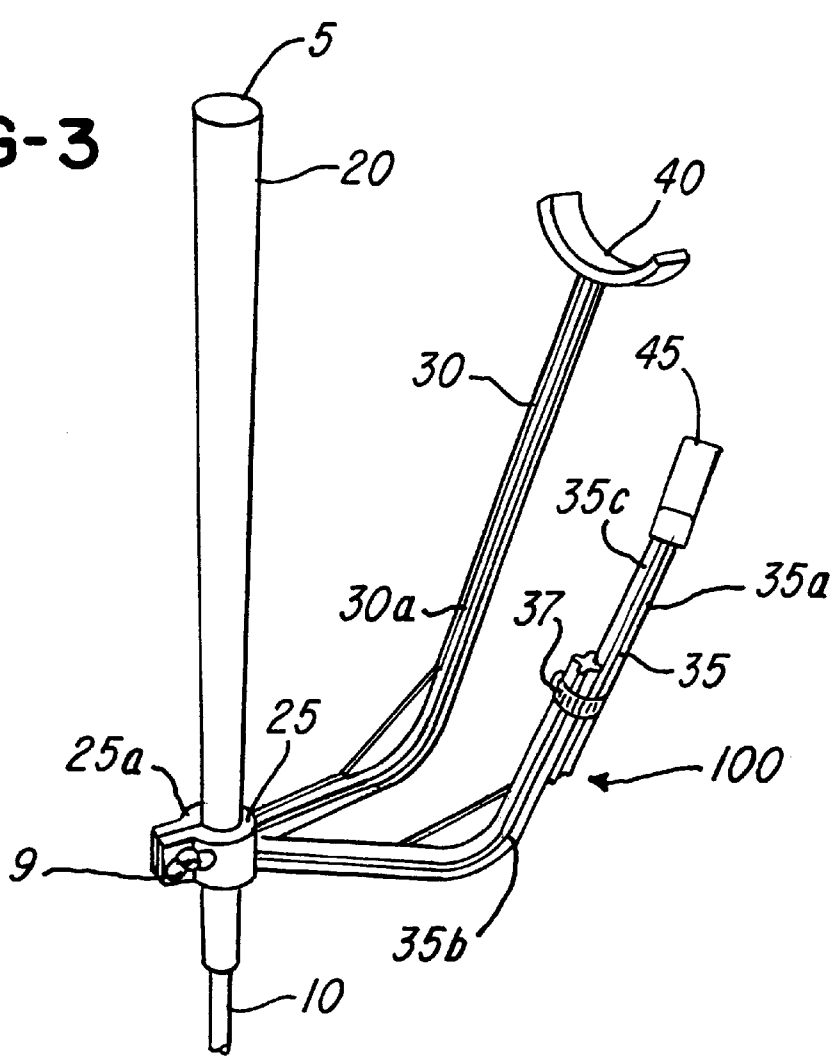
FIG. 3 is a fragmentary view taken in the direction of arrow A in FIG. 2 illustrating the apparatus mounted on a golf club for use by a right-handed golfer shown at the top of his backswing.
Figure 2:
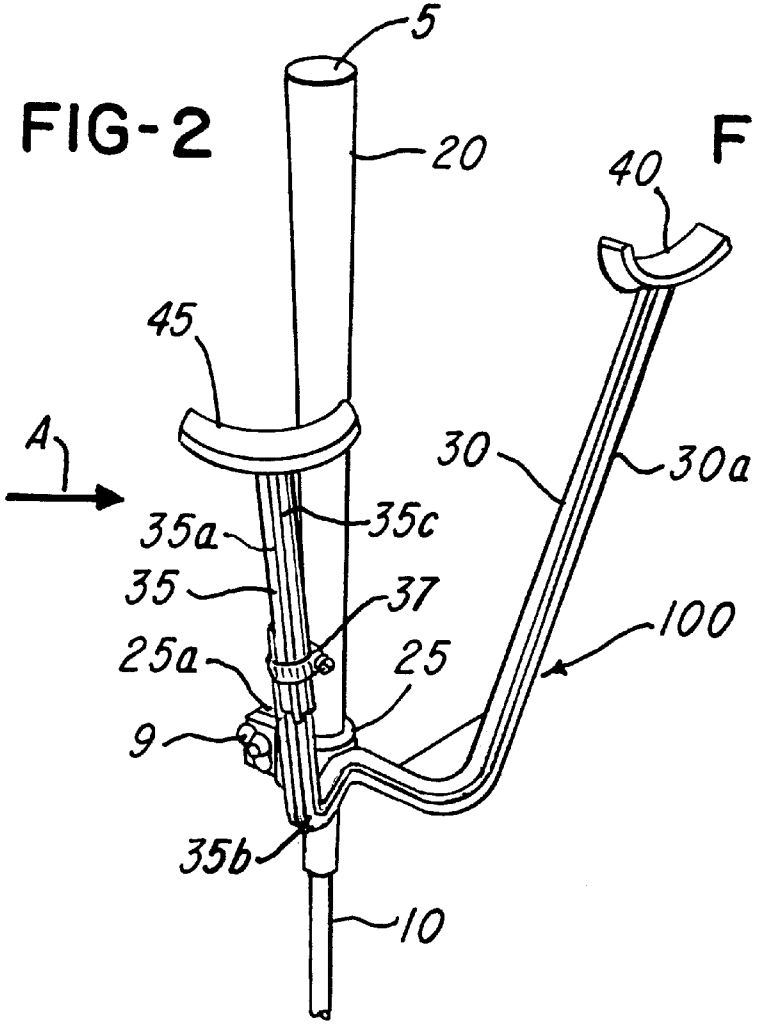
FIG. 2 illustrates the apparatus mounted on a golf club for use by a right-handed golfer shown in an address position.
Figure 6:
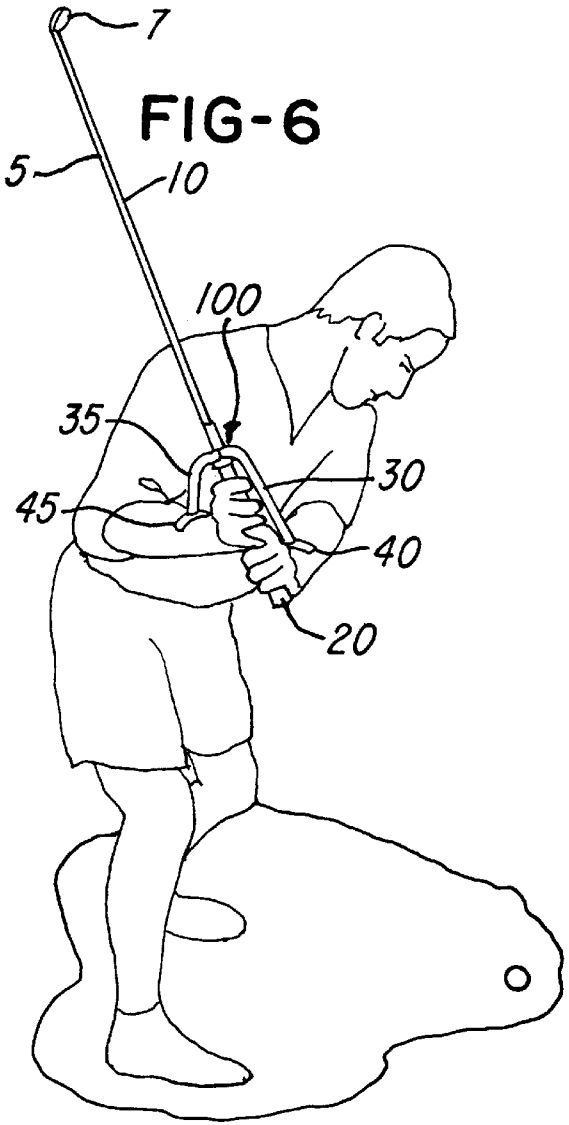
FIGS. 5 and 6 are enlarged views of the apparatus illustrating the apparatus engaging the forearms of the right-handed golfer during his backswing position.
Figure 5:
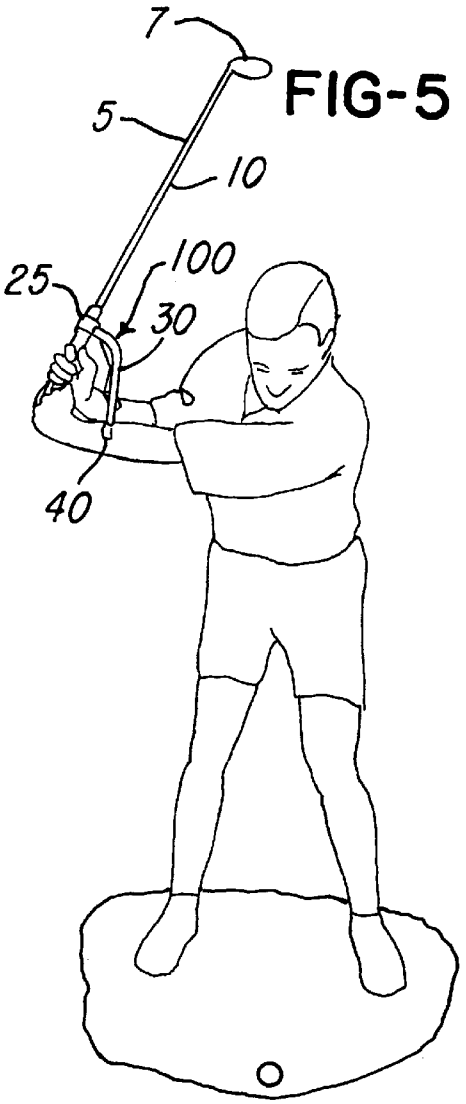
Figure 4:
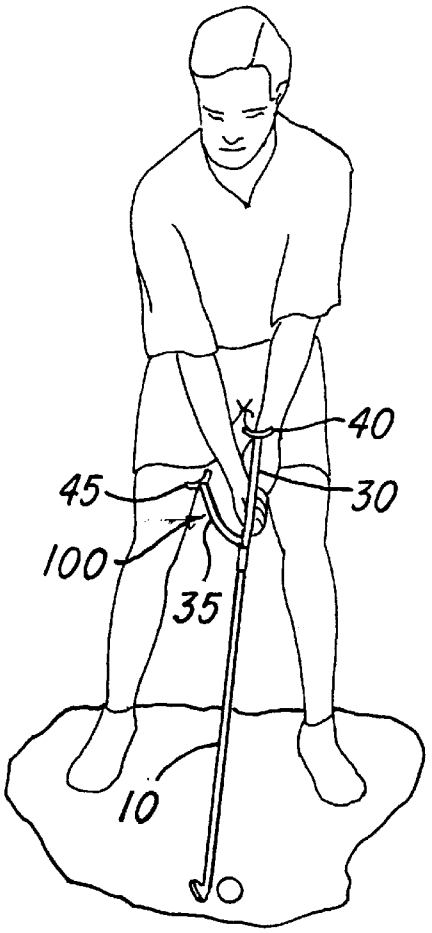
FIG. 4 illustrates a position of the apparatus by a right-handed golfer during an address position.
Figure 7:
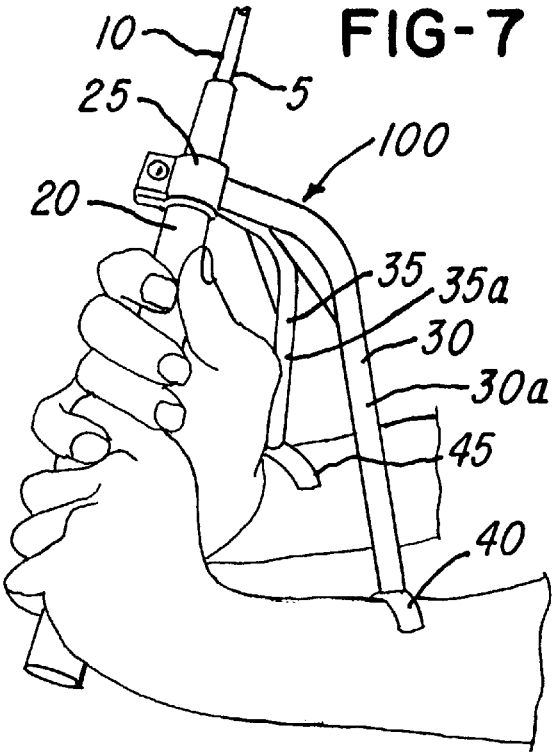
FIG. 7 is an enlarged fragmentary view of the view shown in FIG. 5, illustrating use of the apparatus by a right-handed golfer during his backswing.
Figure 8:
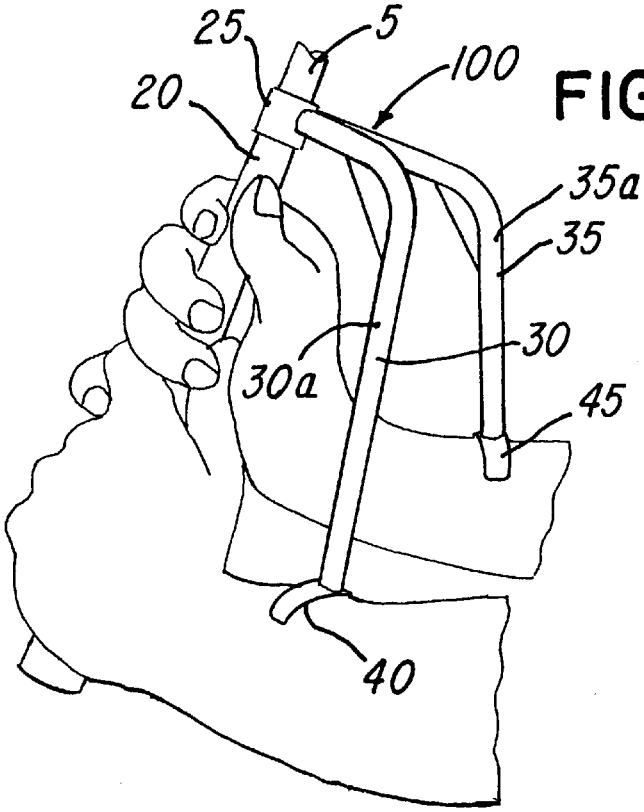
FIG. 8 is an enlarged fragmentary view, similar to FIG. 7, illustrating the position of the apparatus by a right-handed golfer during his backswing.

With reference to FIGS. 1–3, the golf swing enhancer apparatus of the present invention is illustrated. The apparatus is used with any golf club 5. The golf club 5 includes a shaft 10, a grip 20 and a club face 7 (FIGS. 4 and 5). The golf swing enhancer apparatus 100 is a one-piece apparatus which comprises a collar 25 which is engagingly connected to the golf club 5 at a position immediately adjacent the grip 20 and approximately 10 inches down from the top of the golf club. The collar 25 is comprised of an open-ended style clamp 25*a* (FIGS. 1–3) which is attached to golf club 5 and which can be tightened and/or loosened by means of a butterfly nut and bolt 9. When the nut and bolt are loosened, the apparatus 100 can be fit over the golf club and positioned on the grip 20 according to user preference. Once positioned at a desired location, the nut and bolt 9 are tightened. Two arms 30 and 35 are connected to the collar 25 at ends 30*a* and 35*a* and extend outwardly approximately 3 inches from the collar. The arms 30 and 35 are separated from each other by an angle of approximately 52°. As shown in FIG. 1, the arms 30 and 35 curve upwardly and are coupled to and support curved members 40 and 45, respectively.

As shown in FIGS. 1–4, arm 30 is L-shaped and is longer in the upwardly curving portion 30*a* of the arm 30 compared to an upwardly curving portion 35*a* of L-shaped arm 35. Preferably, the upwardly curving portion 30*a* of L-shaped arm 30 is approximately 7½ inches in length while the upwardly curving portion 35*a* of L-shaped arm 35 is approximately 4 inches in length.

For a right-handed golfer, the longer of the two L-shaped arms 30 is positioned at the top of the club, as shown in FIG. 4, and is aligned with the club face 7. The top of L-shaped arm 30 is spaced approximately 5½ inches out from the grip 20. The shorter of the two L-shaped arms 35 is positioned to the left as viewed in FIG. 4 or to the right of the club 5 when viewed from the top of the grip 20 looking down towards the club face 7.

At the second end of the two L-shaped arms 30 and 35 are the curved members 40 and 45, respectively. These curved members 40 and 45 are the portions of the apparatus 100 which will come into contact with the golfer's forearms during parts of the full swing.

The two L-shaped arms 30 and 35 of the apparatus 100 do not contact the golfer's arms when he is standing in position to address the ball, as shown in FIG. 4. The two L-shaped arms 30 and 35 and their curved members 40 and 45 are positioned in length and angle to contact both the leading and trailing forearms of the golfer when the backswing of the club 5 reaches the correct height for a well-executed backswing, as best illustrated in FIGS. 5–8, and then returns to contact both forearms of the golfer at the end of a well-executed follow-through. As shown in the embodiment illustrated in FIGS. 2 and 3, the arm 35 may comprise two sections 35*b* and 35*c* which are adjustably coupled together with a fastener 37. The fastener 37 permits the sections 35*b* and 35*c* to be adjustably fastened together so that the overall length of arm 35 can be increased or decreased as desired.

Figure 9:
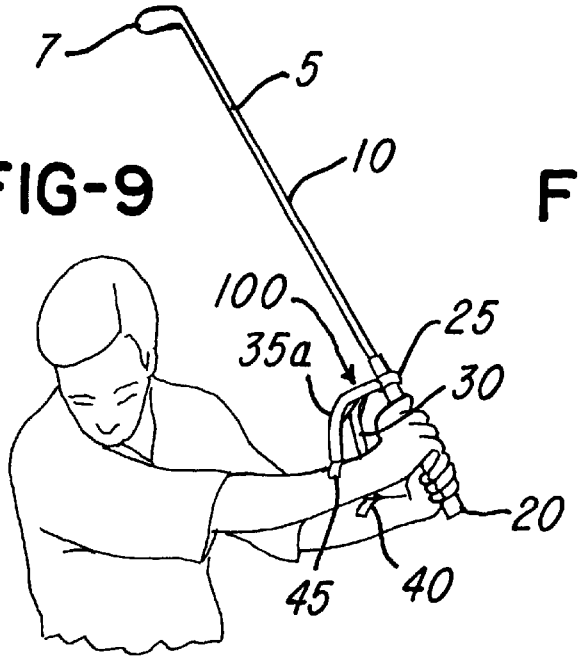
FIG. 9 is a fragmentary view of the apparatus illustrating how the apparatus engages the forearms of the right-handed golfer part way through the follow-through swing position.
Figure 10:
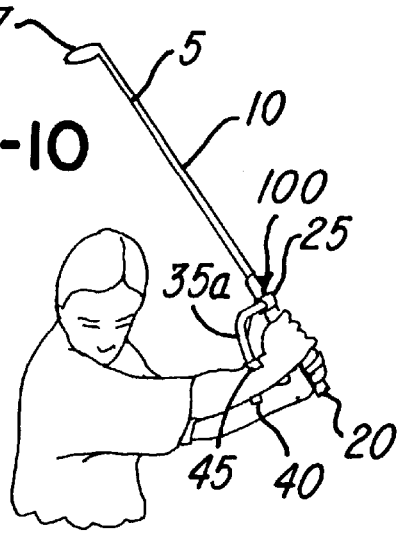
FIG. 10 is another fragmentary view similar to FIG. 9, showing the apparatus engaging the forearms.
Figure 11:
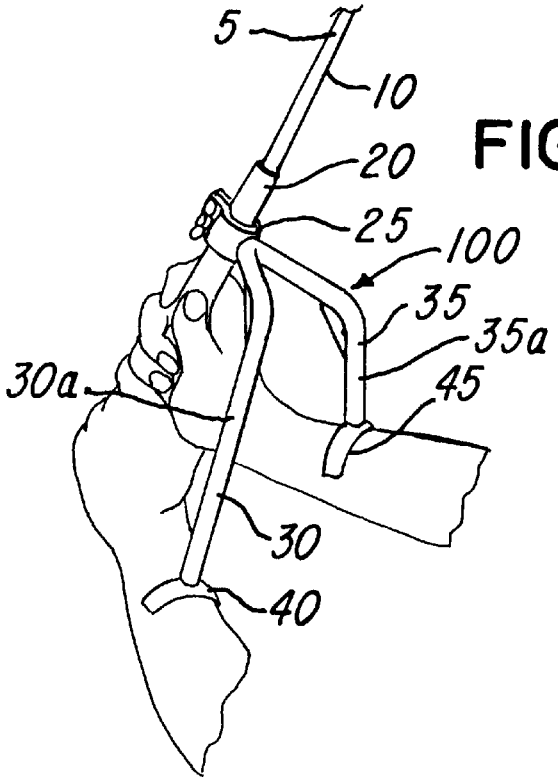
FIG. 11 is a fragmentary enlarged view of a portion of the follow through (as viewed from behind the right-handed golfer), further illustrating the apparatus engaging the forearms during the backswing.

Use of the golf swing enhancer apparatus 100 ensures proper club face rotation in the back swing and down swing, a correct swing plane and the correct positioning of the arms for the back swing and down swing. As the club 5 is properly rotated and hinged in the back swing (FIGS. 5–8) and follow-through swing (FIGS. 9–11), the curved members 40 and 45 of the L-shaped arms 30 and 35, respectively come in contact simultaneously with both forearms of the golfer, thereby keeping the club 5 in balance and on its proper swing plane. Conversely, if the golfer does not execute a correctly positioned swing, the curved members 40 and 45 do not properly contact the golfer's forearms.

In the preferred embodiment, the apparatus 100 is manufactured as a unitary piece and can be comprised of moldable or castable plastic. Other lightweight metals and reinforced plastic composites can also be used. The dimensions of the apparatus 100 may need to be modified for non-adult or shorter golfers. The golfer may use the golf swing enhancer apparatus 100 attached to any club 5 and may practice his full swing repetitiously, with or without contacting a golf ball, so that, when the apparatus is removed from the club 5, the correct positioning for the four parts of the full swing have been committed to the golfer's memory.

It will be apparent to those skilled in the art that various modifications and variations can be made in the apparatus of the present invention without departing from the scope or spirit of the invention. Thus, it is intended that the present invention cover the modifications and variations of this invention provided they come within the scope of the appended claims and their equivalents.

What is claimed is:

1. A golf swing enhancer apparatus for use with a golf club, the golf club including a shaft, a grip and a club face, the club face for contacting a golf ball on the down swing of a full swing of the golf club by a golfer, the apparatus comprising:

a collar engagingly connected to the golf club at a position immediately adjacent the grip; and two L-shaped arms, each of the two L-shaped arms being connected to the collar at a first end and extending outwardly from the collar and upwardly towards the top of the golf club, each of the two L-shaped arms having a curved member at a second end, each of the curved members which do not engage the golfer during said golfer's address position, but do engage a separate one of the forearms of the golfer during various points in the full swing of the golf club when the golfer executes the full swing;

said two L-shaped arms comprising a first L-shaped arm and a second L-shaped arms; said first L-shaped arm defining a length which is greater than a length of said second L-shaped arm.

2. The golf swing enhancer apparatus as claimed in claim 1 wherein the two L-shaped arms each comprise outwardly extending portions approximately three inches in length.

3. The golf swing enhancer apparatus as claimed in claim 1 wherein the two L-shaped arms are separated from each other by an angle of approximately 52°.

4. The golf swing enhancer apparatus as claimed in claim 1 wherein an upwardly extending portion of a first one of the two L-shaped arms is longer than an upwardly extending portion of a second one of the two L-shaped arms.

5. The golf swing enhancer apparatus as claimed in claim 4 wherein the upwardly extending portion of the first one of the two L-shaped arms is approximately 7½ inches in length and the upwardly extending portion of the second one of the two L-shaped arms approximately 4 inches in length.

6. The golf swing enhancer apparatus as claimed in claim 5 wherein the first one of the two L-shaped arms is positioned at the top of the golf club and aligned with the club face when the apparatus is used by a right-handed golfer.

7. The golf swing enhancer apparatus as claimed in claim 6 wherein the second one of the two L-shaped arms is positioned on the right side of the club as viewed looking down the shaft of the club towards the club face.

8. The golf swing enhancer apparatus as claimed in claim 6 wherein the top of the first one of the two L-shaped arms is spaced approximately 5½ inches out from the grip of the golf club.

9. The golf swing enhancer apparatus as claimed in claim 5 wherein the first one of the two L-shaped arms is positioned at the top of the golf club and aligned with the club face when the apparatus is used by a left-handed golfer.

10. The golf swing enhancer apparatus as claimed in claim 9 where in the second one of the two L-shaped arms is positioned on the left side of the club as viewed looking down the shaft of the club towards the club face.

11. The golf swing enhancer apparatus as claimed in claim 1 wherein the apparatus is comprised of moldable plastic.

12. The golf swing enhancer apparatus as claimed in claim 1 wherein the collar is positioned approximately 10 inches down from the top of the golf club.

13. A golf swing enhancer apparatus for use with a golf club, the golf club comprising a shaft, a grip and a club face for contacting a golf ball on the downswing of a full swing of the golf club by a golfer, the apparatus comprising:

a collar for detachably and adjustably mounting the apparatus to the golf club;

a first arm having a first end coupled to said collar and a second end comprising a first member; and a second arm having a first end coupled to said collar and a second end comprising a second member; said first arm defining a first length and said second arm defining a second length, said first length being greater than said second length, and said first and second arms being disposed apart from each other a predetermined angle;

said collar being adjustably and detachably mounted on the golf club such that said first and second arms do not engage the golfer's forearms during the address position, yet engage said golfer's forearms at various points during the full swing of the golf club.

14. The apparatus as defined in claim 13 wherein each of said first and second arms are substantially L-shaped and comprise an outwardly extending portion and an upwardly extending portion.

15. The apparatus as defined in claim 14 wherein said outwardly extending portion is at least 3 inches.

16. The apparatus as defined in claim 14 wherein said upwardly extending portion is at least 7½ inches for one of said arms.

17. The apparatus as defined in claim 13 wherein said predetermined angle is at least 52°.

18. The apparatus as defined in claim 13 wherein said apparatus is a one-piece molded construction.

19. A method for enhancing a swing comprising the steps of:

providing an apparatus for mounting on a golf club, the golf club comprising a shaft, a grip and a club face for contacting a golf ball on the downswing of a full swing of the golf club by a golfer, the apparatus comprising:

said apparatus comprising:

a collar for detachably and adjustably mounting the apparatus the golf club;

a first arm having a first end coupled to said collar and a second end comprising a first member; and a second arm having a first end coupled to said collar and a second end comprising a second member; said first arm defining a first length and said second arm defining a second length, said first length being greater than said second length, and said first and second arms being disposed apart from each other a predetermined angle;

said method comprising the steps of:

adjustably and detachably mounting said apparatus on the golf club such that said first and second members become engage a golfer's first and second forearms, respectively, during the full swing of the golf club, but not during the golfer's address position.

20. The method as recited in claim 19 wherein said collar is situated on the grip at least ten inches from an end of the golf club.

21. The method as recited in claim 19 wherein said first and second members engage the golfer's right and left forearms, respectively, for a right-handed golfer.

22. The method as recited in claim 19 wherein said first and second members engage the golfer's left and right forearms, respectively, for a left-handed golfer.

23. The method as defined in claim 19 wherein each of said first and second arms are substantially L-shaped and comprise an outwardly extending portion and an upwardly extending portion.

24. The method as defined in claim 23 wherein said outwardly extending portion is at least 3 inches.

25. The method as defined in claim 23 wherein said upwardly extending portion is at least 7½ inches.

26. The method as defined in claim 19 wherein said predetermined angle is at least 52°.

27. The method as defined in claim 19 wherein said apparatus is a one-piece molded construction.

* * * * *